US009845951B2

(12) United States Patent
Bachmann et al.

(10) Patent No.: US 9,845,951 B2
(45) Date of Patent: Dec. 19, 2017

(54) GRATE STEP MODULE FOR A THRUST COMBUSTION GRATE

(71) Applicant: Martin GmbH fuer Umwelt-und Energietechnik, Munich (DE)

(72) Inventors: Joerg Bachmann, Buerglen/TG (CH); Peter Alpiger, Wil (CH)

(73) Assignee: Martin GmbH fuer Umwelt-und Energietechnik, Munich (DE)

( * ) Notice: Subject to any disclaimer, the term of this patent is extended or adjusted under 35 U.S.C. 154(b) by 896 days.

(21) Appl. No.: 14/352,703

(22) PCT Filed: Sep. 19, 2012

(86) PCT No.: PCT/DE2012/000926
§ 371 (c)(1),
(2) Date: Apr. 18, 2014

(87) PCT Pub. No.: WO2013/056687
PCT Pub. Date: Apr. 25, 2013

(65) Prior Publication Data

US 2015/0027355 A1 Jan. 29, 2015

(30) Foreign Application Priority Data

Oct. 21, 2011 (EP) ..... 11186180

(51) Int. Cl.
*F23H 7/08* (2006.01)
*F23H 3/02* (2006.01)

(52) U.S. Cl.
CPC ..... *F23H 7/08* (2013.01); *F23H 3/02* (2013.01)

(58) Field of Classification Search
CPC ... F23H 3/02; F23H 17/12; F23H 3/04; F23H 7/08; F23H 17/00; F23H 7/10;
(Continued)

(56) References Cited

U.S. PATENT DOCUMENTS 717,034 A * 12/1902 Schwiebus ..... F23L 1/02 110/312
1,646,111 A * 10/1927 Reid ..... F23L 1/00 110/297
(Continued)

FOREIGN PATENT DOCUMENTS

DE 914 664 C 7/1954
EP 1 281 913 A2 2/2003
(Continued)

OTHER PUBLICATIONS

International Search Report of PCTDE2012/000926, dated Jan. 10, 2013.

*Primary Examiner* — David J Laux
(74) *Attorney, Agent, or Firm* — Collard & Roe, P.C.

(57) ABSTRACT

A grate step module (1) for a thrust combustion grate for the combustion of refuse in a large-scale plant has a carrier part (2) for the grate steps (3, 4), exactly one fixed grate step (3) and exactly one movable grate step (4) and also a grate step drive. The movable grate step (4) is displaceable back and forth with respect to the fixed grate step (3) by way of the grate step drive. The grate step module (1) is connectable in a row with further grate step modules (1) without a gap and in this way forms the thrust combustion grate.

9 Claims, 6 Drawing Sheets

Figure 1:
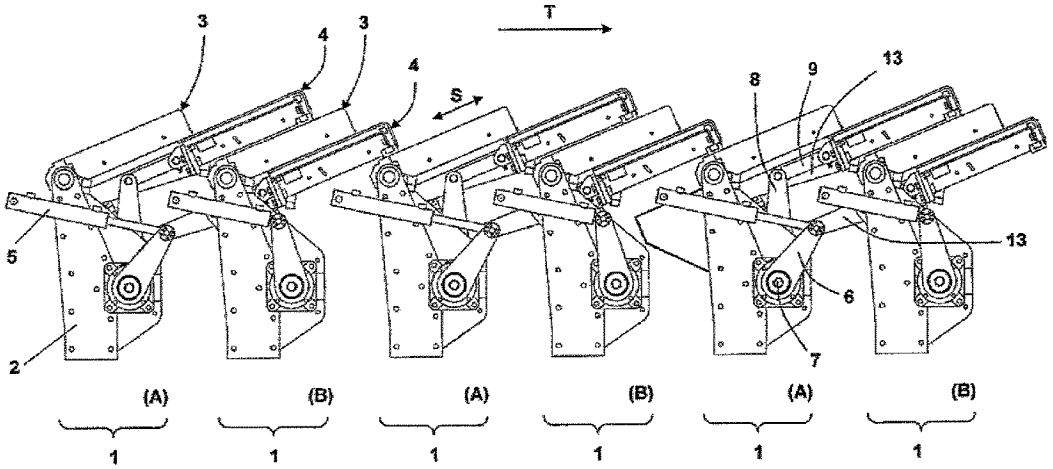

(58) Field of Classification Search
CPC . F23H 13/00; F23H 17/08; F23H 1/02; F23H 7/18; F23H 11/12; F23G 5/444; F23G 5/002; F23L 13/00; F23L 1/00; F23L 1/02; F23M 9/00
USPC ..... 110/291, 310, 312, 268, 298, 297
See application file for complete search history.

(56) References Cited

U.S. PATENT DOCUMENTS 3,651,770 A * 3/1972 Hotti ..... F23H 7/10 110/257
3,917,444 A * 11/1975 Carthew ..... B01J 6/00 165/909
4,018,168 A * 4/1977 Andreoli ..... F23H 7/08 110/268
5,044,288 A * 9/1991 Barlow ..... F23L 1/02 110/300
5,259,362 A * 11/1993 Krieger ..... F23H 17/00 110/281
5,528,992 A * 6/1996 Cole ..... F23G 5/444 104/134
6,964,237 B2 * 11/2005 Hepp ..... F23G 5/002 110/298
2003/0024449 A1 * 2/2003 Martin ..... F23H 7/08 110/268
2006/0011114 A1 * 1/2006 Esser ..... F23H 3/02 110/298
2010/0122643 A1 * 5/2010 Cole ..... F23G 5/444 110/298
2010/0151268 A1 * 6/2010 Schantz ..... B32B 15/01 428/594
2013/0014680 A1 * 1/2013 Corbani ..... F23G 5/002 110/257

FOREIGN PATENT DOCUMENTS

EP 1 617 143 A2 1/2006
JP H07-4634 A 1/1995
WO 95/18333 A1 7/1995
WO 2011-063912 A1 6/2011

* cited by examiner

GRATE STEP MODULE FOR A THRUST COMBUSTION GRATE

CROSS REFERENCE TO RELATED APPLICATIONS

This application is the National Stage of PCT/DE2012/000926 filed on Sep. 19, 2012, which claims priority under 35 U.S.C. §119 of European Application No. 11186180.3 filed on Oct. 21, 2011, the disclosure of which is incorporated by reference. The international application under PCT article 21(2) was not published in English.

The invention relates to a grate step module for a thrust combustion grate for the incineration of waste in a large-scale plant according to claim 1.

The invention relates in particular to a grate step module for a thrust combustion grate for the incineration of waste in a large-scale plant, wherein the grate step module comprises a carrier part for the grate steps.

Thrust combustion grates for the incineration of waste have been known for a long time. Thrust combustion grates of this type have a number of movable grate steps that are suitable for carrying out thrust strokes and in this manner conveying the material to be incinerated in the desired direction on the combustion grate. Typically, in such infeed grates every second grate step is stationary, while the grate steps situated in between them are held so as to be mechanically movable. It is also known that during operation such thrust combustion grates are subject to enormous mechanical, thermal and chemical stress. Thrust combustion gates are therefore, as a rule, heavy metal structures whose installation, deinstallation and maintenance are very expensive because of their heavy weight and the severe wear and tear.

An example of a thrust combustion grate module for incinerating waste in large-scale systems is known from WO-95/18333. This module comprises several reciprocating grate steps, a primary air supply and a slag collection device. The module as a whole including all the drive elements, supply elements and control elements forms an indivisible prefabricated installation module. The module has a supporting chassis-like frame structure for all the grate steps or for the entire grate. Savings in weight are achieved in particular in that supporting elements and the are made from weight-saving hollow sheet-metal bodies through which in their installed state a liquid medium can flow, thus cooling said hollow sheet-metal bodies. Because of this liquid cooling of the most important elements, during operation the components can be kept at relatively low temperatures, which are subjected only to small fluctuations, so that in the case of narrow grate step tracks at least in some cases the expansion compensation elements can be done without. Overall, while the idea of a modular design is certainly used, it is clearly applicable to a pre-fabricated module that can be installed as an entity and that is suitable for road transport. While this may be advantageous in a new construction, it is rather disadvantageous during maintenance and modification work, because it is likely to be undesirable to have to replace large modules in the case of maintenance work, or because of a specific module design to have to accept limited flexibility in the case of modification work.

In WO-95/18333 each of the movable grate steps is driven by a dedicated hydraulic cylinder-piston unit. The supply line for the coolant, a feed channel for blocking air, and the duct for primary air are routed directly below the grate steps in the longitudinal direction of the combustion grate. The latter means of course that any customisation or change, which may be necessary during operation, to existing zone-air separation is likely to be severely impaired. It is well known that combustion grates are divided into various combustion zones because greatly different conditions prevail, depending on the combustion zone, which conditions in each case also require different ventilation and cooling. Zone adjustments may be necessary, for example, if the type and composition of the waste to be incinerated changes permanently.

It is thus the object of the invention to state a grate step module for a combustion grate for the incineration of waste in a large-scale plant, which grate step module is easier to manage in terms of installation and maintenance and provides greater flexibility with regard to the adaptability of the zone air separation.

This object is met by a grate step module having the features described herein.

The solution is provided in that in a generic grate step module exactly one fixed grate step and exactly one movable grate step and also a grate step drive are provided. In this design the movable grate step is displaceable back and forth with respect to the fixed grate step by way of the grate step drive. Furthermore, the grate step module is connectable, without a gap, in a row with further grate step modules of the same type. This firstly provides an advantage in that in a simple manner it is possible to form thrust combustion grates of any desired length.

This design also provides an additional advantage in that basically between two grate step modules zone-air separation can be installed in a simple manner in the form of a zone separating plate. In this way the desired greater flexibility in terms of adaptability of the zone-air separation in waste incineration plants is achieved.

Of course, with regard to the module design disclosed in WO-95/18333 it should be mentioned that a substantial absence or a complete absence of longitudinal ducts that extend directly underneath the grate steps in the direction of conveyance of the combustion grate for conveying air or coolant, greater flexibility in terms of the adaptability of the zone-air separation is, of course, very helpful. The further details below show that the flexibility that is desired in this respect can in many cases actually be achieved because of the special design of the grate step plates on the grate steps. On the one hand it is to be assumed that even with the conventional design of grate step plates not all the zones of a combustion grate always require additional cooling; and on the other hand by means of the special design, mentioned below, of the grate step plates it is additionally possible that only a few zones or zone regions finally require cooling at all. The special design of the grate step plates, which are preferably attachable individually, provides for the grate step plates on the side facing the material to be incinerated to comprise suitable weld cladding. In this manner, even in the case on non-cooled grate step plates greater wear resistance can be achieved when compared to conventional grate step plates without weld cladding. Of course, in the interior such grate step plates can in addition comprise a meandering duct for guiding a coolant through the grate step plate, which because of the cooling effect naturally still further improves wear resistance of the grate step plates. It goes without saying that a modular concept with relatively simple modules of a small size, irrespective of the cooling requirement in individual zones or individual module groups, is probably always sensible and advantageous in terms of generally facilitating maintainability.

The simple modular design provides a further advantage in that the grate step modules can, in principle, comprise different step heights or different step shapes. The ability of such differently designed grate step modules to be aligned in a row always requires only a minimum of design adjustments. Furthermore, the different step heights or the different step shapes can, of course, be formed in the fixed grate step or in the movable grate step. Such deviations in shape can be advantageous in order to ensure reliable onward conveyance of the material to be incinerated.

The grate step module according to the invention provides a further advantage in the particularly simple and reliable mechanism by means of which the back and forth movement of the movable grate step is generated. To this effect the grate step drive comprises a hydraulic cylinder on each side of the grate step module, wherein the hydraulic cylinders are of course controlled synchronously and in common. By way of drive levers that are arranged on both sides, a drive shaft, further drive levers and reversing levers, the hydraulic cylinders cause the back and forth displacement of the movable grate step. Thus in a simple manner a rotary movement of the drive shaft is converted to a purely translatory back and forth movement of the movable grate step, and the hydraulic cylinders as force-generating drive elements are, furthermore, arranged in less exposed lateral regions. In this design the translatory guidance of the movable grate step takes place by way of guide carriers that are firmly connected to the movable grate step, and by way of guide rollers that are mounted to the carrier part.

Furthermore, the design according to the invention of the grate step module makes it possible to implement even very wide grates in a simple manner. Because of the increased weight load this basically only requires elements of the grate step module, in particular of course the carrier part, to be designed accordingly in terms of strength. Known grates of conventional designs are usually divided into individual grate tracks that are approx. 2-3 meters in width. Centre bars to accommodate expansion are usually installed between these grate tracks. Such centre bars are very expensive to manufacture and to maintain. With the design according to the invention of the grate step module it is basically possible to implement grates with overall widths exceeding 6 meters without there being a need for centre bars. To compensate for thermal expansion of the individual components it is, of course, nonetheless necessary to provide suitable technical measures, however, as a rule, these are easier to design if no centre bars need to be provided.

Figure 2:
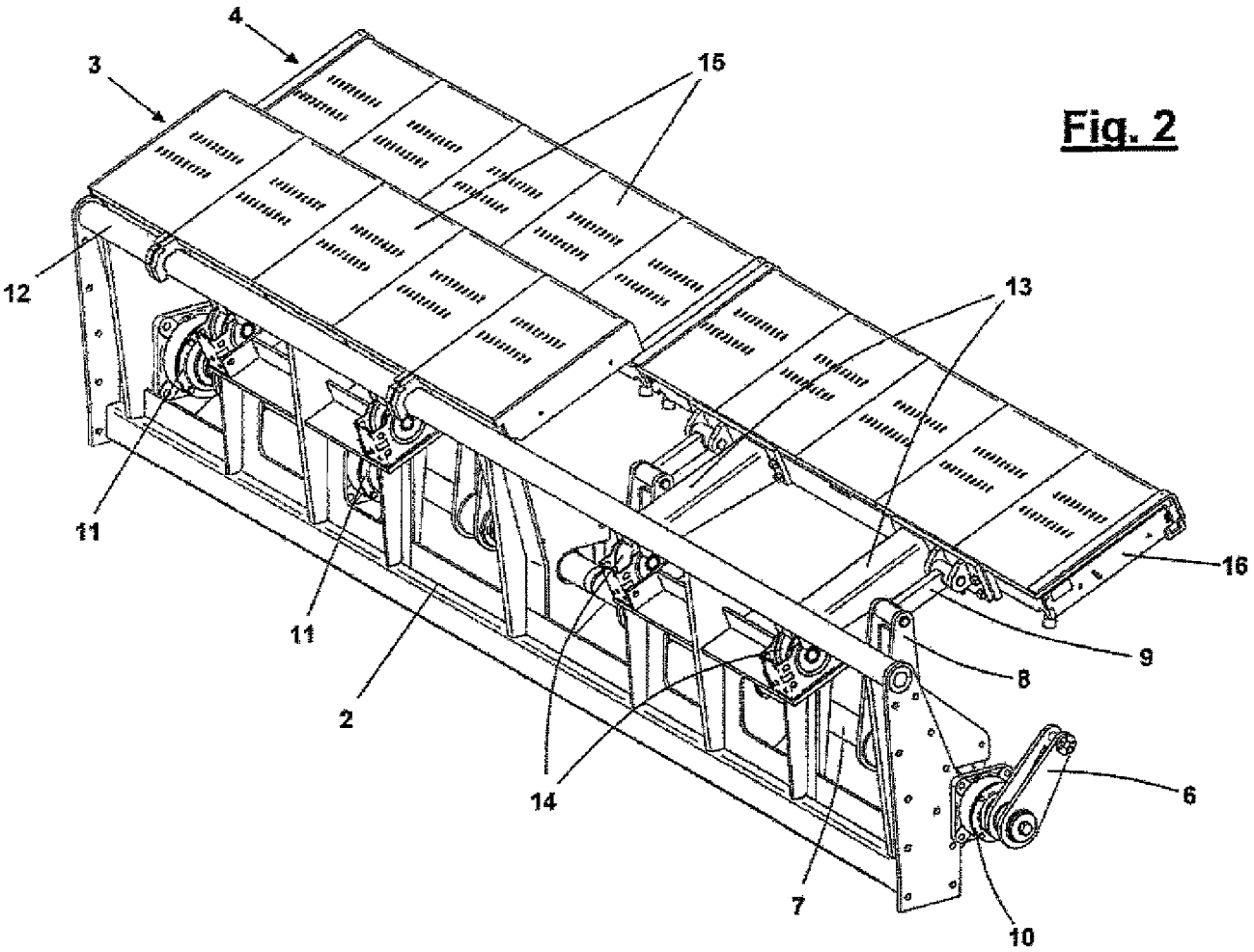
Figure 3:
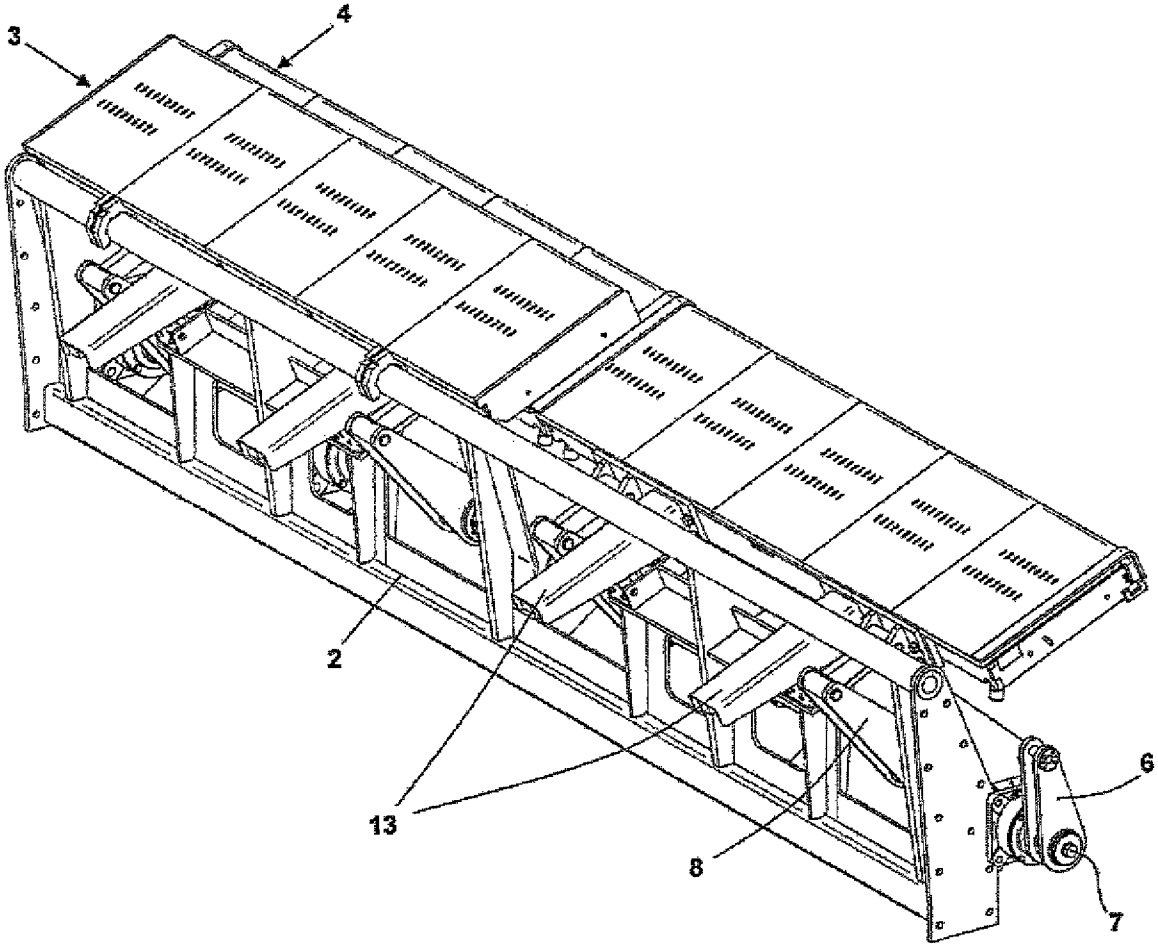
Figure 4:
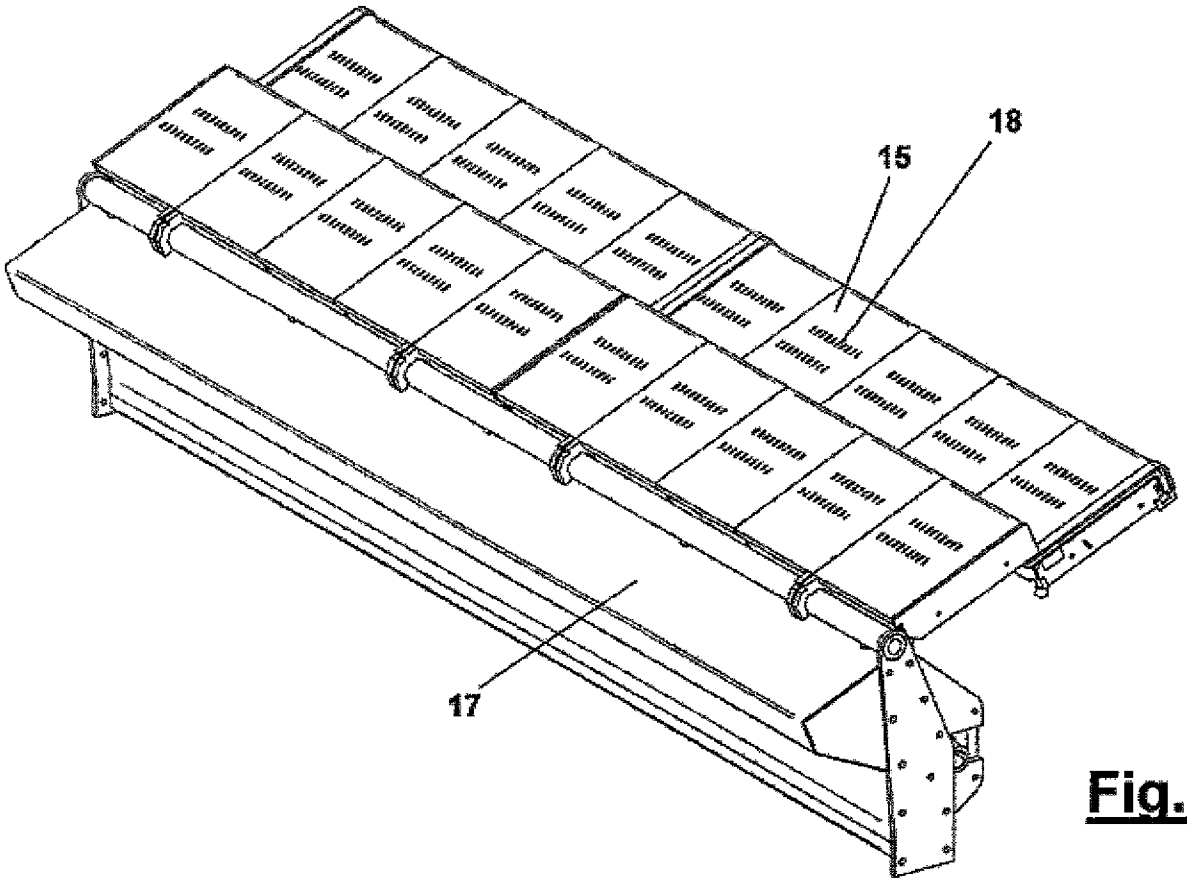
Figure 5:
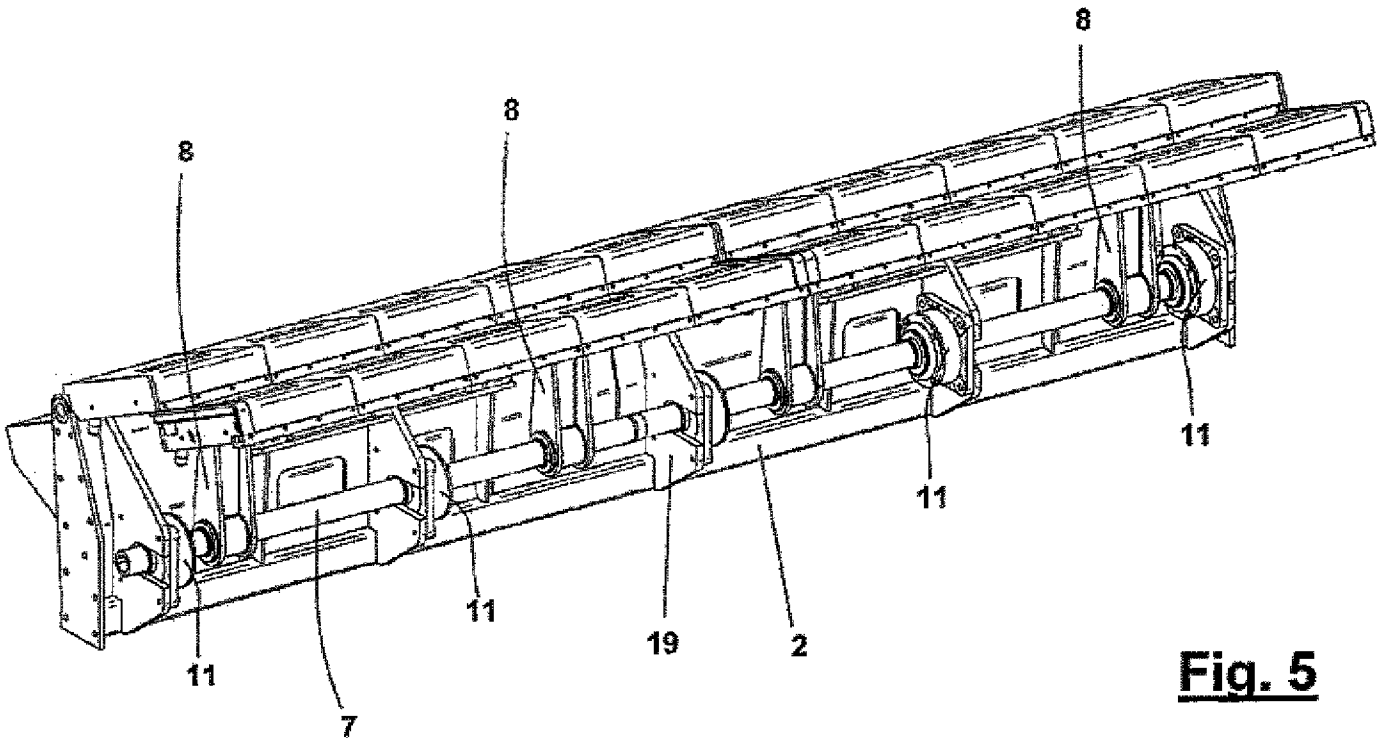
Figure 6:
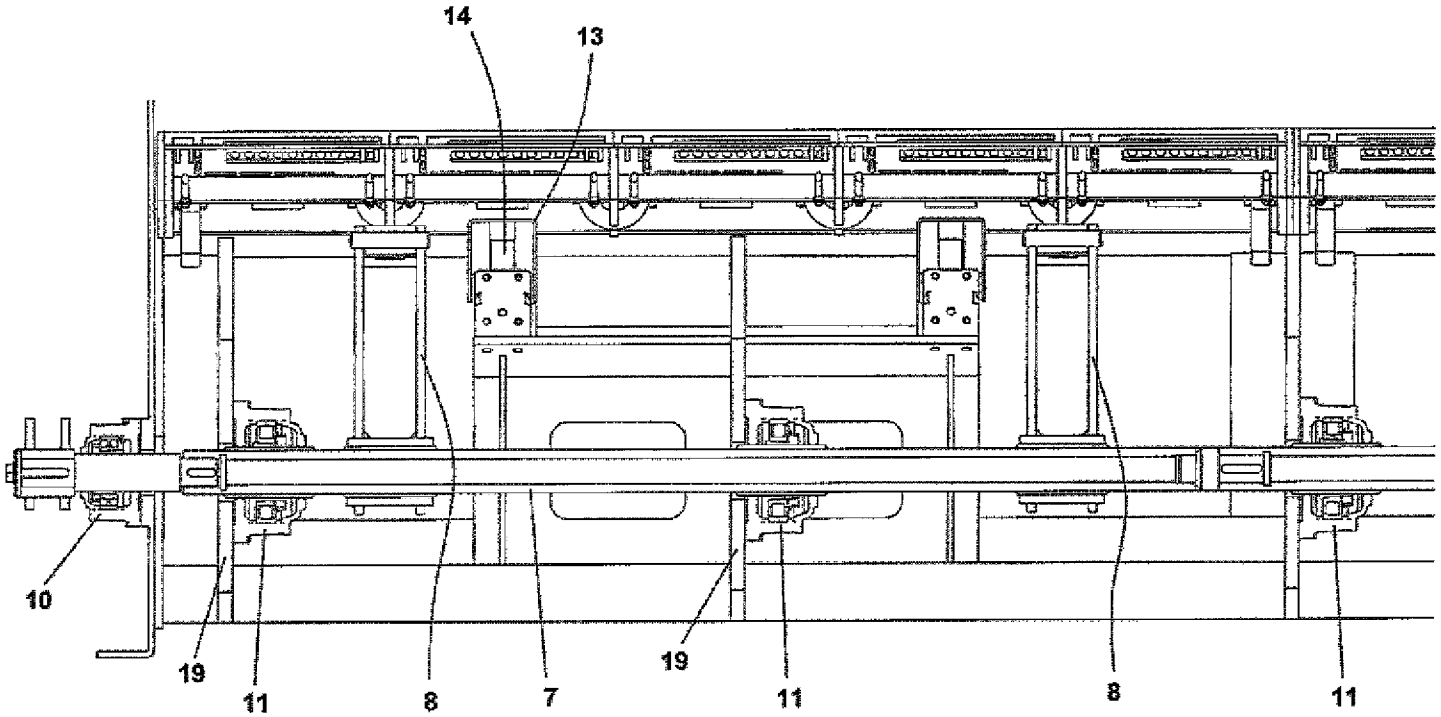

Below, the invention is explained in detail with reference to drawings showing one exemplary embodiment. The following are shown:

FIG. 1 a diagrammatic lateral view of a thrust-combustion grate in which a number of grate step modules according to the invention are aligned in a row;

FIG. 2 a spatial partial view of a grate step module from the rear with the movable grate step in its advanced position;

FIG. 3 a spatial partial view of the grate step module of FIG. 2 from the rear with the movable grate step in its retracted position;

FIG. 4 a spatial partial view of the grate step module of FIG. 2 from the rear with a zone separating plate in place;

FIG. 5 a spatial partial view of the grate step module of FIG. 4 from the front; and FIG. 6 a partial view of the grate step module according to FIGS. 2-5 from the front.

FIG. 1 shows a diagrammatic lateral view of a thrust-combustion grate in which a number of grate step modules (1) according to the invention are aligned in a row. The grate step module (1) has a carrier part (2), exactly one fixed grate step (3), exactly one movable grate step (4) and a grate step drive with hydraulic cylinders (5) as force-generating drive elements. By means of the grate step drive the movable grate step (4) is displaceable back and forth with respect to the fixed grate step (3). The grate step module (1) is connectable in a row with further grate step modules (1) without a gap and in this way forms the entire thrust combustion grate. As an example, the diagram shows six grate step modules (1) connected in a row, but in principle the number of connected grate step modules (1) can be selected at will.

If grate step modules (1) as shown in FIG. 1 are connected in a row without a gap, the pattern arises which is typically used in combustion grates, in which pattern every second grate step is arranged so as to be stationery, while the grate steps situated in between are held so as to be mechanically movable. Furthermore, the illustration according to FIG. 1 shows the commonly used control principle for the movable grate steps 4, in which principle alternately one movable grate step 4 is in the maximum advanced position (A) while a further, following, movable grate step 4 is in the maximum retracted position (B); and in the case of more than two grate step modules 1 this occurs in turn in alternating sequence. In this manner the material to be incinerated (not shown) is gradually pushed forward, in the direction of transport (T), on the thrust combustion grate. In this process the individual movable grate steps 4 move back and forth in a translatory manner in a direction (S).

In this document the term "grate step drive" refers to the group of components by means of which a movable grate step 4 is moved in a translatory manner. Some of these components are at least partly visible in FIG. 1 (for further clarification refer, in particular, to FIG. 2). The pivotally mounted hydraulic cylinder 5 acts on a drive lever 6 that causes a drive shaft 7 to rotate. On the drive shaft 7, further drive levers 8 are mounted so as to be angularly offset. Reversing levers 9 are pivoted to the further drive levers 8, which reversing levers 9 in turn are also pivoted to the movable grate step 4. In this manner the originally translatory back and forth movement of the pistons of the hydraulic cylinders 5 is converted to a rotary movement of the drive shaft 7 and is finally converted back to a translatory back and forth movement of the movable grate plates 4. This mechanism is shown particularly clearly in FIG. 1 by the movable grate steps 4 in its maximum advanced position (A).

FIG. 2 shows a spatial partial view of the grate step module 1 from the rear with the movable grate step 4 in its maximum advanced position (A). A partial region of the fixed grate step 3 has been left out in the diagram so that the mechanism situated underneath it is shown more clearly.

The drive shaft 7 has outer drive shaft bearings 10 and inner drive shaft bearings 11 by means of which it is held on the carrier part 2. This bearing arrangement will be discussed in more detail in the context of FIG. 5. The fixed grate step 3 is mounted to a support 12 which in turn is firmly connected to the carrier part 2. The movable grate step 4 has rearwards-projecting guide carriers 13 that are firmly connected to said movable grate step 4. Furthermore, guide rollers 14 are mounted to the carrier part 2, on which guide rollers 14 the guide carriers 13 rest, and by means of which guide rollers 14 the guide carriers 13 and thus also the movable grate plate 4 are guided in their back and forth movement.

FIG. 2 also clearly shows that both the fixed grate step 3 and the movable grate step 4 are constructed from individual grate step plates 15. In this arrangement the grate step plates 15 can be individually attached to a plate carrier 16.

FIG. 3 shows a spatial partial view of the grate step module of FIG. 2 from the rear with the movable grate step 4 in its maximum retracted position (3). The illustration clearly shows that in this position the guide carriers 13 project rearwards a little. However, in grate step modules 1 aligned in a row this rearward projection does not in any way impede the function of the module situated behind.

FIG. 4 shows a spatial partial view of the grate step module of FIG. 2 from the rear with a zone separating plate 17 in place. The zone separating plate 17 can be designed as a single-piece continuous cover part and is preferably detachably attached to the carrier part 2 in a suitable form. It is thus possible in this manner at the desired or necessary positions to introduce zone-air separation as required between the individual grate step modules 1, aligned in a row, of a combustion grate. In this manner the quantity of supplied fresh air that in a specific combustion zone is to enter the combustion space through ventilation slits 18 in the grate step plates 15 can be controlled flexibly and in a targeted manner. For the sake of clarity the means for supplying and distributing fresh air, which means are of course also situated underneath the combustion grate, are not shown in the illustrations. However, these means, just like the means for slag removal, relate to conventional designs that do not require further explanation.

FIG. 5 shows a spatial partial view of the grate step module of FIG. 4 from the front. The drive shaft 7 and attachment of it are shown particularly clearly. To this effect the carrier part 2 comprises supporting members 19, spaced apart from each other, to which the drive shaft 7 with the inner drive shaft bearings 11 is detachably attached in a manner that the drive shaft can be removed, in its entirety without the need for deinstallation of the carrier part 2, from a combustion grate frame (not shown). However, for this purpose the outer drive shaft bearings 10 (compare FIG. 2) and the hydraulic cylinders also require prior deinstallation. In this manner it is ensured that even parts of the grate step module 1 can be replaced on site.

Finally, in a supplementary manner, FIG. 6 shows a partial view of the grate step module according to FIGS. 2-5 from the front. In particular, the illustration clearly shows parts of the grate step drive, for example the drive shaft 7, the further drive levers, and the inner and the outer drive shaft bearings 11, 10. In addition, the illustration shows that further measures for facilitating replacement of the drive shaft 7 are provided, for example division of the drive shaft 7 into drive shaft segments, or the ability to separate the outer drive shaft bearing 10 together with the hydraulic cylinder 5.

LIST OF REFERENCE CHARACTERS

1 Grate step module
2 Carrier part
3 Fixed grate step
4 Movable grate step
5 Hydraulic cylinder
6 Drive lever
7 Drive shaft
8 Further drive lever
9 Reversing lever
10 Outer drive shaft bearing
11 Inner drive shaft bearing
12 Support (for fixed grate step)
13 Guide carrier
14 Guide roller
15 Grate step plate
16 Plate carrier
17 Zone separating plate
18 Ventilation slits
19 Supporting member
A Maximum advanced position
B Maximum retracted position
T Direction of transport of the material to be incinerated
S Direction of back and forth displacement

The invention claimed is:

1. A grate step module for a thrust combustion grate for the incineration of waste in a large-scale plant,
- wherein the grate step module comprises a carrier part for grate steps,
- wherein the grate step module has exactly one fixed grate step and exactly one movable grate step and a grate step drive,
- wherein the movable grate step is displaceable back and forth with respect to the fixed grate step by way of the grate step drive, and
- wherein the grate step module is connectable in a row with further grate step modules without a gap in order to form the thrust combustion grate.

2. The grate step module according to claim 1, wherein the grate step module has zone-air separation in the form of a zone separating plate.

3. The grate step module according to claim 2, wherein the zone separating plate is detachably mountable in a rear region of the carrier part.

4. The grate step module according to claim 1, wherein the grate step drive comprises a hydraulic cylinder on each side of the grate step module wherein the hydraulic cylinders are controlled in common.

5. The grate step module according to claim 4, wherein by way of drive levers that are arranged on both sides, a drive shaft, further drive levers and reversing levers, the hydraulic cylinders cause the back and forth displacement of the movable grate step.

6. The grate step module according to claim 1, wherein guidance of the movable grate step takes place by way of guide carriers that are connected to the movable grate step, and by way of guide rollers that are mounted to the carrier part.

7. The grate step module according to claim 1, wherein the fixed and the movable grate steps are provided with individually attachable grate step plates.

8. The grate step module according to claim 7, wherein on the side facing the material to be incinerated the grate step plate comprises weld cladding.

9. A combustion grate for the incineration of waste in a large-scale plant, comprising at least two grate step modules according to claim 1, wherein the grate step modules are connected in a row, and the grate step drives are coordinated.

* * * * *